US009665049B2

(12) United States Patent
Oshima et al.

(10) Patent No.: US 9,665,049 B2
(45) Date of Patent: May 30, 2017

(54) MEMBER FOR ELECTROPHOTOGRAPHY, METHOD FOR MANUFACTURING MEMBER FOR ELECTROPHOTOGRAPHY, AND IMAGE-FORMING APPARATUS

(71) Applicant: CANON KABUSHIKI KAISHA, Tokyo (JP)

(72) Inventors: Yoshihito Oshima, Yokohama (JP); Yuji Kitano, Tokyo (JP); Matsutaka Maeda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/052,551

(22) Filed: Feb. 24, 2016

(65) Prior Publication Data

US 2016/0252854 A1 Sep. 1, 2016

(30) Foreign Application Priority Data

Feb. 26, 2015 (JP) ..... 2015-037024

(51) Int. Cl.
*G03G 15/20* (2006.01)

(52) U.S. Cl.
CPC ..... *G03G 15/2057* (2013.01)

(58) Field of Classification Search
CPC ..... G03G 15/206; G03G 15/2053; G03G 15/2057
USPC ..... 399/333, 330; 430/124.32, 124.33
See application file for complete search history.

(56) References Cited

U.S. PATENT DOCUMENTS 5,385,808 A * 1/1995 Tokoh ..... C08F 283/04 430/281.1
6,001,942 A * 12/1999 Amako ..... C08G 73/1042 528/10
6,183,869 B1 * 2/2001 Okuda ..... B05D 5/083 428/411.1
9,164,450 B2 * 10/2015 Matsumoto ..... G03G 15/206
2006/0084714 A1 * 4/2006 Yoneda ..... C03C 17/30 522/172

FOREIGN PATENT DOCUMENTS

JP 2005212318 A 8/2005

* cited by examiner

*Primary Examiner* — Sophia S Chen
(74) *Attorney, Agent, or Firm* — Canon U.S.A., Inc., IP Division

(57) ABSTRACT

A member for electrophotography includes a substrate, an elastic layer containing a silicone rubber, a surface layer containing a fluorine resin, and an adhesive layer between the elastic layer and the surface layer. The adhesive layer contains a polyimide silicone. When a peel test of the surface layer from the elastic layer is conducted after the member is left in the environment of 260° C. for 10 hours, the elastic layer undergoes a cohesive failure.

12 Claims, 4 Drawing Sheets

MEMBER FOR ELECTROPHOTOGRAPHY, METHOD FOR MANUFACTURING MEMBER FOR ELECTROPHOTOGRAPHY, AND IMAGE-FORMING APPARATUS

BACKGROUND

Field of the Disclosure

The present disclosure relates to a member for electrophotography for use in a fixing device for an electrophotographic image-forming apparatus (hereinafter also referred to simply as "an image-forming apparatus") and a method for manufacturing this member for electrophotography. The present disclosure also relates to an image-forming apparatus in which this member for electrophotography is used.

Description of the Related Art

An example of a member for electrophotography for use in a fixing device for an electrophotographic image-forming apparatus, e.g., a copier or a laser beam printer, is a rotating body which is in the shape of a belt, a roller, or similar. Some known examples of such rotating bodies are composed of a heat-resistant or metallic substrate, a silicone-rubber-containing elastic layer on the substrate, and a fluorine-resin-containing surface layer on the elastic layer.

In the fixing device, two such members for electrophotography face and are pressed against each other, forming a point of pressure contact which is called a fixing nip. When a recording medium (e.g., paper) carrying an image formed by unfixed toner (hereinafter referred to as "a toner image") is introduced to this fixing nip, the elastic layers of the two electrophotographic members enclose the unfixed toner through elastic deformation, and transmit heat to the toner. The heat makes the toner fuse, fixing the image on the recording medium.

When this image-forming process is repeated many times, the members for electrophotography are exposed to high-temperature conditions for a long period of time. This affects the strength of the bond between the surface and elastic layers, potentially leading to the detachment of the surface layer during the use of the members for electrophotography.

Japanese Patent Laid-Open No. 2005-212318 mentions a method that can be a solution to this problem. This method includes applying an aqueous dispersion of a fluorine resin containing phosphoric groups to a piece of silicone rubber, drying the resulting coating, and then covering the piece of silicone rubber with a fluorine resin tube.

SUMMARY

An aspect of the disclosure is directed to providing a member for electrophotography that offers high durability of the bond between its elastic and surface layers and a method for manufacturing this member for electrophotography. Another aspect of the disclosure is directed to providing an image-forming apparatus that enables stable production of high-quality images.

According to another aspect of the present disclosure, there is provided a member for electrophotography including a substrate, an elastic layer containing a silicone rubber, a surface layer containing a fluorine resin, and an adhesive layer between the elastic and surface layers.

The adhesive layer contains a polyimide silicone. When a peel test of the surface layer from the elastic layer is conducted after the member is left in the environment of 260° C. for 10 hours, the elastic layer undergoes a cohesive failure.

According to yet another aspect of the present disclosure, there is provided a method for producing a member for electrophotography including a substrate, an elastic member containing a silicone rubber, and a surface layer containing a fluorine resin. The method includes a step of: bonding the elastic layer and the surface layer by forming, on a surface of the elastic layer, a coating of a polyimide silicone having a vinyl group in a molecule thereof, and curing the coating.

According to further aspect of the present disclosure, there is provided an image-forming apparatus including a fixing device having a fixing member and a heating unit. The fixing member is a member for electrophotography as defined above.

Further features of the present disclosure will become apparent from the following description of exemplary embodiments with reference to the attached drawings.

DESCRIPTION OF THE EMBODIMENTS

In recent years, the market has been demanding more long-lived products from the perspective of resource saving. Thus, a strong bond between the elastic and surface layers needs be maintained for longer than has hitherto been done.

In response to such demands, the inventors used, as a component of a fixing device, a member for electrophotography produced by utilizing a bonding method according to the aforementioned Japanese Patent Laid-Open No. 2005-212318. This study revealed that in the early period of use the bond between the elastic and surface layers is maintained, but repeated use gradually weakens the interlayer bond, potentially making the bond durability insufficient.

The inventors then considered bonding a surface layer containing a fluorine resin to an elastic layer containing a silicone rubber using a polyimide silicone, an adhesive agent commonly used to join metals and other materials. Containing a highly heat-resistant polyimide structure in their molecules, polyimide silicones should be advantageous in preserving bonding strength in high-temperature environments.

Some kinds of polyimide silicones, however, did not successfully stick the fluorine resin to the silicone rubber. With such polyimide silicones, the bonding strength was not sufficiently high even in the early stage of use.

The inventors thus performed further studies in search of a polyimide silicone that provides a member for electrophotography with high bonding strength and durability. Through these studies, the inventors have found that when the two layers are stuck together through the curing of a polyimide silicone having a vinyl group in a molecule thereof, hereinafter referred to as "a vinyl group-containing polyimide silicone", the member for electrophotography possesses high bonding strength both in the early period of use and after a heat-resistance test.

The reason why the use of a vinyl group-containing polyimide silicone provides higher durability in the bonding is considered as follows.

Figure 3:
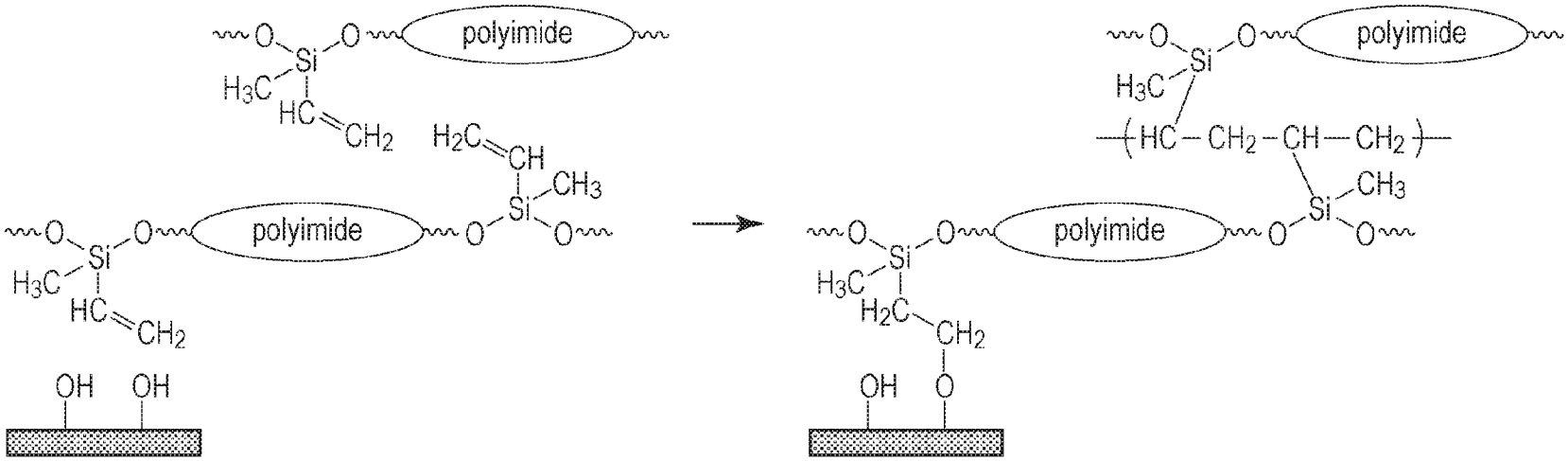
FIG. 3 illustrates a possible mechanism of reaction of a polyimide silicone having a vinyl group in a molecule thereof.

FIG. 3 illustrates a possible mechanism of reaction of a vinyl group-containing polyimide silicone. The surface and elastic layers containing a fluorine resin and a silicone rubber, respectively, have hydroxy groups exposed on their respective surfaces facing the adhesive layer, and some vinyl groups in the uncured polyimide silicone should form chemical connections with these hydroxy groups through addition polymerization. In the adhesive layer, some other vinyl groups in the uncured polyimide silicone undergo addition polymerization, curing the polyimide silicone. It appears to be through such a reaction that a vinyl group-containing polyimide silicone forms strong chemical connections between the elastic and surface layers. Furthermore, as mentioned above, polyimide silicones have the highly heat-resistant polyimide structure. This means that polyimide silicones are intrinsically not very thermally cleavable. The inventors assume that it is this mechanism that makes possible the bond more durable than has hitherto been.

Certain aspects of the disclosure provide a member for electrophotography that offers high durability of the bond between its elastic and surface layers and a method for manufacturing this member for electrophotography. Another aspect of the disclosure provides an image-forming apparatus that enables stable production of high-quality images.

The following is a detailed description of a member for electrophotography according to an aspect of the disclosure and a method for manufacturing it based on a specific structure.

(1) Member for Electrophotography

Figure 1:
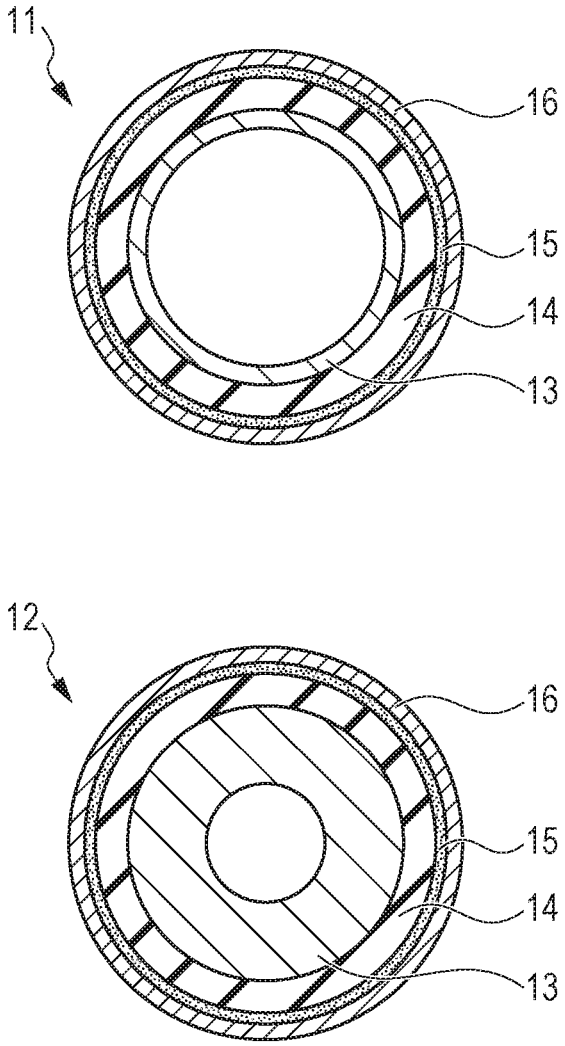
FIG. 1 is a schematic cross-sectional view of two examples of a member for electrophotography according to an aspect of the disclosure.

FIG. 1 is a schematic cross-sectional view of two examples of a member for electrophotography according to an aspect of the disclosure, a fixing belt 11 and a fixing roller 12. The fixing belt 11 is a belt-shaped member for electrophotography, and the fixing roller 12 is a roller-shaped member for electrophotography. In general, the name "fixing belt" is used when the fixing nip is formed through the deformation of the substrate, and "fixing roller" is used when the fixing nip is formed through elastic deformation of an elastic layer rather than the deformation of the substrate.

The fixing belt 11 and the fixing roller 12 each have a substrate 13, an elastic layer 14, a surface layer 16, and an adhesive layer 15 between the elastic layer 14 and the surface layer 16.

(2) Substrate

The substrate 13 can be made of metal, such as aluminum, iron, stainless steel, or nickel, an alloy of such metals, or a heat-resistant resin, such as polyimide.

When the member for electrophotography is in the shape of a roller, the substrate 13 is a metal core. Examples of materials of which the metal core can be made include metals such as aluminum, iron, and stainless steel and alloys of such metals. The metal core can be hollow as long as it is tough enough to withstand pressing in a fixing device. There can be a heat source inside when the metal core is hollow.

When the member for electrophotography is in the shape of a belt, the substrate 13 can be, for example, an electroformed nickel sleeve, a stainless-steel sleeve, or a heat-resistant resin belt made of polyimide. There may optionally be anti-wear, insulating, and other functional layers on the inner surface of the belt (not illustrated).

The outer surface of the substrate 13 may be treated for adhesion to the elastic layer 14. Possible surface treatments include physical processes such as blasting, lapping, and polishing, and chemical processes such as oxidation, application of a coupling agent, and priming. A combination of these surface treatments can also be used.

When the elastic layer 14 described hereinafter is made of silicone rubber, it is customary to ensure adhesion through a surface treatment called priming. The primer used in this process is a coating solution composed of an organic solvent and a silane coupling agent, a silicone polymer, hydrogenated methyl siloxane, an alkoxysilane, catalysts to accelerate hydrolysis, condensation, and addition reactions, and a coloring agent (e.g., red iron oxide) mixed and dispersed as necessary therein. These materials are commercially available. The primer is applied to the surface of the substrate 13 (the surface of contact with the elastic layer 14), followed by processes such as drying and firing to complete priming.

The primer can be of any kind appropriate for the material of which the substrate 13 is made, the kind of the elastic layer 14, and the form of the crosslinking reaction. When the elastic layer 14 is abundant with unsaturated aliphatic groups, the primer may contain hydrosilyl groups, which provide adhesion by reacting with the unsaturated aliphatic groups. In the opposite case, or when the elastic layer 14 is abundant with hydrosilyl groups, the primer may contain unsaturated aliphatic groups. Primers containing alkoxy groups can also be used.

(3) Elastic Layer and its Formation

The elastic layer 14 can be a layer of silicone rubber, in particular, a cured layer of an addition-curing silicone rubber composition. Most addition-curing silicone rubber compositions are liquid and thus serve as good media for the dispersion of filler. This means that by selecting a suitable kind of filler and its quantity, it is possible to control the degree of crosslinking of the cured silicone rubber. The use of an addition-curing silicone rubber composition therefore allows for easy adjustment of elasticity.

The addition-curing silicone rubber composition is a dispersion of additives, such as filler, mixed in an addition-curing silicone rubber solution. Heating the addition-curing silicone rubber composition to induce a hydrosilylation-based crosslinking reaction produces the elastic layer 14 (hereinafter referred to as "the cured silicone rubber elastic layer").

(3-1) Addition-Curing Silicone Rubber Solution

In a typical case, the addition-curing silicone rubber solution is composed of an organopolysiloxane containing unsaturated aliphatic groups, hereinafter referred to as "an unsaturated-aliphatic organopolysiloxane", an organopolysiloxane containing an active hydrogen group bound to silicon, hereinafter referred to as "an active hydrogen organopolysiloxane", a platinum compound as a crosslinking catalyst, and an agent for controlling the curing process (also called an inhibitor).

Examples of unsaturated-aliphatic organopolysiloxanes include the following.

- Linear organopolysiloxanes that have one selected from the group consisting of intermediate units $R1_2SiO$ and R1R2SiO or both of these intermediate units, and also have a molecular terminal $R1_2R2SiO_{1/2}$.
- Branched organopolysiloxanes that have one selected from the group consisting of intermediate units $R1SiO_{3/2}$ and $SiO_{4/2}$ or both of these intermediate units, and also have a molecular terminal $R1_2R2SiO_{1/2}$.

R1 represents a substituted or unsubstituted monovalent hydrocarbon group bound to the silicon atom, excluding unsaturated aliphatic groups. Specific examples include the following:

Alkyl groups (e.g., methyl, ethyl, propyl, butyl, pentyl, and hexyl groups);

Aryl groups (e.g., a phenyl group); and

Substituted hydrocarbon groups (e.g., chloromethyl, 3-chloropropyl, 3,3,3-trifluoropropyl, 3-cyanopropyl, and 3-methoxypropyl groups).

This organopolysiloxane is easy to synthesize and handle and highly resistant to heat when 50% or more of the R1 groups, preferably all R1 groups, are methyl groups.

R2 represents an unsaturated aliphatic group bound to the silicon atom. Examples include vinyl, allyl, 3-butenyl, 4-pentenyl, and 5-hexenyl groups. The use of a vinyl group makes this organopolysiloxane easy to synthesize and handle and, furthermore, helps the crosslinking reaction.

Since mixing in the filler described hereinafter increases the viscosity of the addition-curing silicone rubber composition, it is preferable to employ the unsaturated-aliphatic organopolysiloxane, a base ingredient, having a relatively low viscosity or, in other words, a smaller molecular weight. A weight-average molecular weight, i.e. Mw, can be determined with gel permeation chromatography or GPC. For example, the weight-average molecular weight of the organopolysiloxane may preferably be 150,000 or less, more preferably 70,000 or less. By employing the organopolysiloxane having the weight-average molecular weight of 150,000 or less, it is possible to make a film or to mold more easily.

The active hydrogen organopolysiloxane is a crosslinking agent that reacts with the alkenyl groups of the unsaturated-aliphatic organopolysiloxane catalyzed by the platinum compound to form a crosslinked structure. The number of hydrogen atoms bound to silicon atoms is more than three on average per molecule.

The organic groups bound to silicon atoms can be, for example, substituted or unsubstituted monovalent hydrocarbon groups in the same range as those for R1 in the unsaturated-aliphatic organopolysiloxane component. The use of methyl groups makes this organopolysiloxane easy to synthesize and handle.

The molecular weight of the active hydrogen organopolysiloxane is not limited. The viscosity of this organopolysiloxane at 25° C. may preferably be 10 $mm^2/s$ or more and 100,000 $mm^2/s$ or less, preferably 15 $mm^2/s$ or more and 1000 $mm^2/s$ or less. When having a viscosity in these ranges, the organopolysiloxane does not evaporate during storage to the extent that the intended degree of crosslinking or characteristics of the shaped article would be lost, is easy to synthesize and handle, and readily reaches uniform dispersion in the system where it is present.

The siloxane backbone can be linear, branched, or cyclic, and a mixture of these structures can also be used. Linear organopolysiloxanes are easy to synthesize. The active hydrogen group can be located in any siloxane unit in the molecule, preferably with at least some of them located in a terminal siloxane unit as in $R1_2HSiO_{1/2}$.

The quantity of unsaturated aliphatic groups in the addition-curing silicone rubber solution can be 0.1% by mole or more and 2.0% by mole or less, preferably 0.2% by mole or more and 1.0% by mole or less, per mole of nitrogen atoms.

The ratio of the number of active hydrogen groups to the number of unsaturated aliphatic groups (by mole; hereinafter also referred to as "H/Vi") in the addition-curing silicone rubber solution may preferably be 0.3 or more and 1.5 or less, more preferably be 0.3 or more and 0.8 or less. Ensuring that the H/Vi is in these ranges, the elasticity of the cured silicone rubber elastic layer can control more easily. This is because when the H/Vi is 0.3 or more, the resulting crosslinked structure will provide the cured silicone rubber elastic layer a degree of elasticity sufficiently higher than needed for use in the member for electrophotography, and because when the H/Vi is 1.5 or less, any unreacted unsaturated aliphatic groups left in the cured silicone rubber elastic layer after the crosslinking reaction will construct a crosslinked structure by themselves, reducing the loss of elasticity in the cured silicone rubber elastic layer to a sufficiently low level. The H/Vi can be calculated from, for example, measurements obtained using proton nuclear magnetic resonance spectroscopy, i.e. $^1$H-NMR (trade name, AL400 FT-NMR; JEOL, Ltd.). For example, when the unsaturated aliphatic groups are vinyl groups, the H/Vi can be calculated by determining the integrated intensity of the peak for the (usually three) protons in a vinyl group (5.6 to 6.2 ppm) and that for the proton in an active hydrogen group (the top of the peak at around 4.6 to 4.8 ppm). It should be noted that the chemical shift of a peak for the proton in an active hydrogen group greatly depends on the environment where the silicon atom directly connected to the active hydrogen group is.

The catalyst for hydrosilylation is usually a known substance, such as a platinum or rhodium compound. The reaction-controlling agent can be a known substance, such as methyl vinyl tetrasiloxane, an acetylene alcohol, a siloxane-modified acetylene alcohol, or a hydroperoxide.

(3-2) Filler

The elastic layer 14 may contain filler for improved thermal conductivity and for the purposes of insulation, reinforcement, resistance to heat, workability, and electroconductivity unless it inhibits the advantages of this aspect of the disclosure.

The elastic layer 14 may contain titanium oxide in the anatase form for improved heat resistance. Adding titanium oxide in the anatase form to the elastic layer 14 makes the bond between the elastic layer 14 and the surface layer 16 even more durable. Although the mechanism for this effect has not been characterized in detail, it has been found that adding titanium oxide in the anatase form improves the durability of the bond between the elastic layer 14 and the surface layer 16 particularly when the ratio of the number of active hydrogen groups to the number of unsaturated aliphatic groups (H/Vi) in the addition-curing silicone rubber solution is relatively low (i.e., when the increase in hardness described hereinafter is relatively low). To be more specific, adding titanium oxide in the anatase form to the elastic layer 14 is advantageous particularly when the H/Vi is 0.3 or more and 0.8 or less.

Furthermore, the elastic layer 14 may contain a thermally conductive filler for improved thermal conductivity through the elastic layer 14.

(3-2-1) Titanium Oxide

Titanium oxide is known to have several forms which are called anatase, rutile, and so forth. In this aspect of the disclosure, it is possible to use titanium oxide in the anatase form (hereinafter also referred to as "anatase titanium oxide"). Titanium oxide in any other structure may also be contained unless it inhibits the advantages of this aspect of the disclosure, but the higher the anatase titanium oxide content the better. In other words, titanium oxide crystals in the silicone rubber become more effective with decreasing percent rutile as calculated according to formula (1) in accordance with the method described in ASTM D3720-84. To be more specific, the percent rutile can be 50% or less, preferably 20% or less.

$$\text{Percent rutile (\% by mass)} = 100 - 100/(1 + 1.2 \times Ir/Ia) \quad (1)$$

In formula (1), Ir is the area of the X-ray diffraction peaks corresponding to the interference maxima of titanium oxide crystals in the rutile form (plane indices of 110), and Ia is the areas of the X-ray diffraction peaks corresponding to the interference maxima of titanium oxide crystals in the anatase form (plane indices of 101).

The quantity of the anatase titanium oxide can be 0.2 parts by mass or more and 20 parts by mass or less, preferably 1 part by mass or more and 5 parts by mass or less, per 100 parts by mass of the addition-curing silicone rubber solution. Ensuring that the quantity of the anatase titanium oxide is 0.2 parts by mass or more will provide sufficient durability of the elasticity of the elastic layer. Ensuring that the quantity of the anatase titanium oxide is 20 parts by mass or less will prevent the structural viscosity of the addition-curing silicone rubber from being too high.

The quantity of the anatase titanium oxide that provides heat resistance to the elastic layer 14 is reduced with decreasing primary particle diameter of the titanium oxide. To be more specific, the volume-average diameter of the primary particles of the anatase titanium oxide can be 5 nm or more and 100 nm or less, in particular, 20 nm or more and 40 nm or less.

This volume-average diameter of the primary particles of the anatase titanium oxide in the elastic layer 14 is a value determined using a flow particle image analyzer (trade name, FPIA-3000; Sysmex Corporation). The following is a detailed description of a process for this. A sample sectioned out of the elastic layer 14 is heated to 1000° C. in a ceramic crucible in a nitrogen atmosphere to decompose and remove the rubber component. The crucible is then heated to 1000° C. in an air atmosphere to burn off gas-phase-grown carbon fibers. The crucible now contains only particles of titanium oxide originating in the sample. The particles of titanium oxide in the crucible are then crushed into primary particles using a mortar and pestle. The obtained primary particles are dispersed in water to form a sample liquid. This sample liquid is put into the particle image analyzer, and a static image of the inorganic filler is taken while the liquid is passed through an imaging cell in the analyzer.

The planar projection of a particle of the inorganic filler (hereinafter also referred to as "a particle projection") has a certain area, and the diameter of a circle having the same area (hereinafter also referred to as "an equal-area circle") is defined as the diameter of the particle of titanium oxide corresponding to the particle projection. The arithmetic mean of the diameters of the equal-area circles of 1000 titanium oxide particles is defined as the volume-average diameter of the primary particles of titanium oxide.

The crystal structure of titanium oxide particles can be identified using X-ray powder diffraction (XRD). The measurement is performed using a horizontal-sample-mount multipurpose X-ray diffractometer (trade name, Ultima IV; Rigaku Corporation) under the following conditions.

X-ray source: Cu-Kα radiation
Tube voltage/current: 30 kV/20 mA
Scanning range: 10° to 80°
Scanning rate: 2.0°/min
Sampling rate: 0.01°
Number of integrations: 3

The measured X-ray diffraction profile has a diffraction peak of maximum intensity characteristic of the indices of the crystal plane of anatase titanium oxide particles (101) at around a 2θ of 25.3°.

(3-2-2) Thermally Conductive Filler

The thermally conductive filler can be a highly heat-conductive filler. To be more specific, the thermally conductive filler can be an inorganic substance, in particular, metal, a metallic compound, or carbon fiber. Specific examples of highly heat-conductive fillers include the following: silicon carbide (SiC); silicon nitride ($Si_3N_4$); boron nitride (BN); aluminum nitride (AlN); alumina ($Al_2O_3$); zinc oxide (ZnO); magnesium oxide (MgO); silica ($SiO_2$); copper (Cu); aluminum (Al); silver (Ag); iron (Fe); nickel (Ni); gas-phase-grown carbon fibers; PAN (polyacrylonitrile)-based carbon fibers; and pitch-based carbon fibers. A mixture of two or more of these fillers can also be used. Highly heat-conductive fillers having an average diameter of 1 μm or more and 50 μm or less are easy to handle and highly dispersible. The highly heat-conductive filler can be in the shape of spheres, powders, needles, plates, or whiskers. Spherical fillers are highly dispersible.

The quantity of the thermally conductive filler in the elastic layer can be 30 vol % or more and 60 vol % or less with respect to the addition-curing silicone rubber for the purpose of use of the filler to be fully accomplished.

(3-3) Formation of the Elastic Layer

In a method for manufacturing a member for electrophotography according to an aspect of the disclosure, the elastic layer 14 can be formed by applying an addition-curing silicone rubber composition, which contains the ingredients described above, in the form of a layer to the outer peripheral surface of the substrate through molding, blade coating, nozzle coating, ring coating, or similar techniques and then heating this layer.

The outer surface of the elastic layer 14 may be treated with, for example, ultraviolet radiation or plasma before the formation of the adhesive layer 15 described hereinafter. Such a surface treatment reinforces the bond between the elastic and adhesive layers by producing many OH groups on the surface of the elastic layer 14.

When ultraviolet treatment is performed, the source of ultraviolet radiation can be ultraviolet radiation having a wavelength of 175 nm. A specific example of a source of ultraviolet radiation is an excimer lamp. The conditions of ultraviolet irradiation can be such that the cumulative dose per unit area of ultraviolet radiation having a wavelength of 175 nm is 300 mJ/cm$^2$ or more and 1000 mJ/cm$^2$ or less. The dose of ultraviolet radiation can be measured using an ultraviolet power meter (trade name, C8026/H8025-172; Hamamatsu Photonics).

The thickness of the elastic layer 14 can be designed to be appropriate in consideration of the contribution to the surface hardness of the member for electrophotography and nip width availability.

When the member for electrophotography is in the shape of a belt, the thickness of the elastic layer 14 can be 100 μm or more and 500 μm or less, preferably 200 μm or more and 400 μm or less. Selecting the thickness of the elastic layer 14 from these ranges will ensure that the substrate 13 deforms well and provides a sufficiently large nip width when the fixing belt is installed in a fixing device. When there is a heat source inside the belt, furthermore, selecting the thickness of the elastic layer 14 from these ranges will lead to efficient transfer of heat from the heat source to the recording medium. When the member for electrophotography is in the shape of a roller, it is needed to create a nip width through the deformation of the elastic layer 14 because the substrate 13 is rigid. This means that the elastic layer 14 is thicker than in the case of a fixing belt. To be more specific, the thickness of the elastic layer 14 can be 300 μm or more and 10 mm or less, preferably 1 mm or more and 5 mm or less.

As for strength, the tensile strength (TS) of the elastic layer 14 as measured using a type-3 dumbbell test piece according to JIS K6251: 2010 can typically be 0.4 MPa or more and 3.0 MPa or less, in particular, 1.0 MPa or more and 2.5 MPa or less. The elastic layer 14 is sufficiently strong for use as a component of the member for electrophotography when its TS is in these ranges.

The TS of the elastic layer 14 can be enhanced by increasing the degree of polymerization of the organopolysiloxane in the silicone rubber composition. To be more specific, the TS of the elastic layer 14 can be enhanced by, for example, increasing the proportions of unsaturated aliphatic groups and active hydrogen groups bound to silicon in relation to the number of silicon atoms.

(3-4) Abundance of Unsaturated Aliphatic Groups in the Elastic Layer

Allowing unsaturated aliphatic groups to be present in the elastic layer 14 will ensure that the silicone rubber in the elastic layer 14 is resistant to aging. These unsaturated aliphatic groups form new connections even if the crosslinked structure in the silicone rubber is broken.

It is difficult to measure the quantity of unsaturated aliphatic groups in the elastic layer 14 directly, but indirect measurement is possible through the following method.

First, thin pieces of cured silicone rubber in a predetermined size (e.g., 20 mm×20 mm) are cut out of the elastic layer 14 of the member for electrophotography and stacked to a thickness of 2 mm. Then the type-C microhardness of the obtained stack is measured using a micro durometer (MD-1 capa Micro Durometer, Type C; Kobunshi Keiki Co., Ltd.). The measured microhardness is expressed as Hμ0.

Then all of the thin pieces of silicone rubber constituting the stack are immersed in methyl hydrogen silicone oil (trade name, DOW CORNING TORAY SH 1107 FLUID; Dow Corning Toray) and left for 24 hours with the temperature of the methyl hydrogen silicone oil maintained at 30° C. (hereinafter also referred to as "24-hour dipping"). This makes the methyl hydrogen silicone oil penetrate to the inside of each thin piece. Then all of the thin pieces that have gone through the 24-hour dipping are removed from the methyl hydrogen silicone oil and fully cleared of the oil on the surface. After 4 hours of heating in an oven at 200° C., the thin pieces are allowed to cool to room temperature. This ensures that all thin pieces complete the primary reaction, i.e., reaction between unsaturated aliphatic groups and methyl hydrogen silicone oil. Then all of the thin pieces are stacked together, and the microhardness of the stack is measured using the aforementioned durometer. This microhardness is expressed as Hμ1. The factor of increase in hardness (=Hμ1/Hμ0) is then calculated.

When unsaturated aliphatic groups are abundant in the elastic layer, the methyl hydrogen silicone oil penetrating to the inside of the test pieces forms new crosslink points in the test pieces. The heat treatment therefore makes the test pieces significantly harder, and the factor of increase in hardness is relatively large.

When unsaturated aliphatic groups are scarce in the elastic layer, heating the test pieces impregnated with methyl hydrogen silicone oil does not produce many new crosslink points. The heat treatment therefore causes only a slight change in the hardness of the test pieces, and the factor of increase in hardness is relatively small.

The experiment for determining the factor of increase in hardness can also be performed under other conditions unless the reaction of unsaturated aliphatic groups in the test pieces is incomplete.

The factor of increase in hardness can be 1.0 or more, in particular, 1.2 or more. Making the elastic layer relatively abundant with unsaturated aliphatic groups will effectively prevent the loss of elasticity associated aging.

The factor of increase in hardness can be 5.0 or less, in particular, 2.0 or less. This stabilizes the crosslinked structure in the elastic layer.

The factor of increase in hardness can be controlled by adjusting the formula of the addition-curing silicone rubber solution used to form the elastic layer.

In other words, the abundance of unsaturated aliphatic groups in the elastic layer can be increased by changing the proportions of the unsaturated-aliphatic and active hydrogen organopolysiloxanes in the addition-curing silicone rubber solution to adjust the ratio of the number of moles of unsaturated aliphatic groups to that of active hydrogen groups in the addition-curing silicone rubber solution or, to be more specific, to increase the number of moles of unsaturated aliphatic groups relative to that of active hydrogen groups. Through this, it is possible to increase the factor of increase in hardness.

(4) Adhesive Layer

The adhesive layer 15 has an important function in ensuring the durability of the bond between the elastic layer 14 and the surface layer 16.

The adhesive layer 15 contains a polyimide silicone. The polyimide silicone as mentioned herein is a compound having a polyimide structure and an organosiloxane structure in a molecule thereof.

The adhesive layer 15 can be a cured layer of a vinyl group-containing polyimide silicone (a polyimide silicone having a vinyl group in a molecule thereof). The adhesive layer 15 can be formed by coating the elastic layer 14 with a solution that contains a vinyl group-containing polyimide silicone and curing the resulting coating.

The vinyl group-containing polyimide silicone may have the vinyl groups in the form of a side-chain group attached to the organosiloxane structure. The organosiloxane structure can be a dimethylsiloxane structure.

Typical examples of vinyl group-containing polyimide silicones include polyimide silicones that have any of the units represented by formulae (1) to (3) and any of the units represented by formulae (4) to (6).

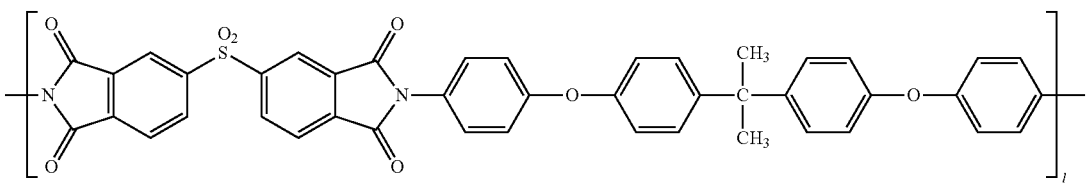

(1)

-continued (2)

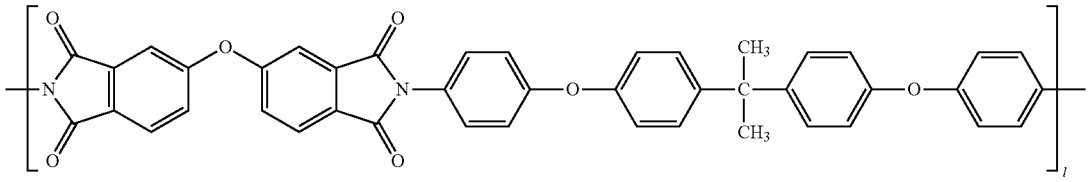

(3)

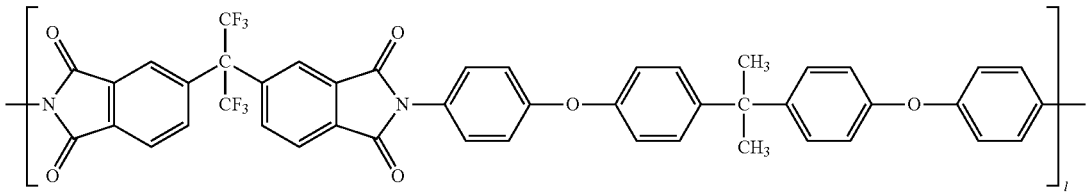

(4)

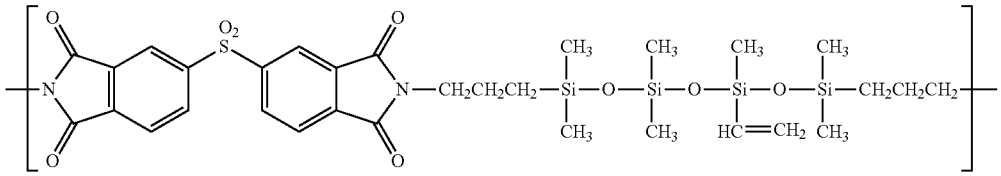

(5)

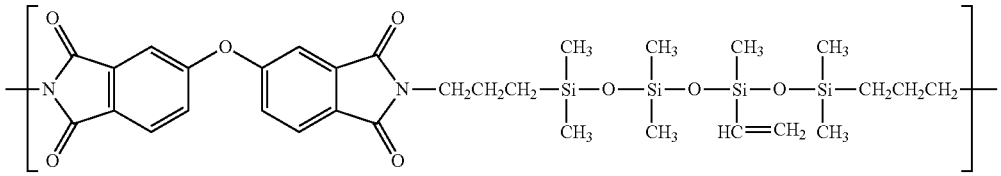

(6)

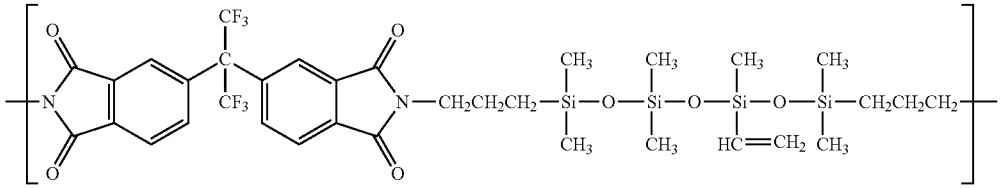

The solution of a vinyl group-containing polyimide silicone in an organic solvent can be a commercially available product (trade name, SMP-5005-PGMEA; Shin-Etsu Chemical).

The solution of a vinyl group-containing polyimide silicone in an organic solvent may contain a vinyl-free polyimide silicone unless it inhibits the advantages of this aspect of the disclosure.

The higher the abundance of vinyl groups in the polyimide silicone in the coating is, the more durable the resulting bond is.

The thickness of the adhesive layer 15 can be 0.5 μm or more and 10 μm or less, preferably 1 μm or more and 5 μm or less. Making the thickness of the adhesive layer 15 0.5 μm or more will ensure uniformity of the adhesive layer, which leads to high bond durability. Making the thickness of the adhesive layer 15 10 μm or less will ensure high adhesiveness without compromising the flexibility of the member for electrophotography and, when the member for electrophotography is a fixing member, lead to good thermal conductivity to the recording medium such as paper.

(5) Surface Layer

The surface layer 16 can be made of one or a combination of fluorine resins, such as the following resins: tetrafluoroethylene-perfluoroalkyl vinyl ether copolymers (PFA), polytetrafluoroethylene (PTFE), and tetrafluoroethylene-hexafluoropropylene copolymers (FEP). In particular, PFA is easier to shape and more smoothly releases toner than the other listed resins.

The thickness of the surface layer 16 can be 5 μm or more and 50 μm or less, preferably 10 μm or more and 30 μm or less. Five micrometers is a minimum thickness to which this layer can be formed easily. Making the thickness of this layer 50 μm or less will ensure good thermal conductivity from the member for electrophotography to the recording medium such as paper.

(6) Bonding the Elastic and Surface Layers Together

First, the outer periphery of the elastic layer 14 formed using the method described above is coated with a solution of uncured polyimide silicone in an organic solvent, and the resulting coating is dried. For coating, known techniques can be used including spray coating, slit coating, blade coating, roll coating, and dip coating. For drying, air-drying and heating are possible. When heating is used, the temperature can be 50° C. or more and 150° C. or less, preferably 80° C. or more and 120° C. or less. Heating to any temperature exceeding 150° C. can cause the adhesive layer to start curing. The heating time can be 1 minute or more and 2 hours of less or, to be more specific, approximately 1 hour. There is no particular upper limit to the drying time, and the process of drying can be ended when the solvent in the adhesive layer has fully evaporated.

The surface layer 16 is then formed on the resulting coating. The formation of the surface layer 16 is not limited to any particular method. Examples include the following methods.

The elastic layer 14 with the coating thereon is covered with a fluorine resin tube, a fluorine resin in the shape of a tube obtained through extrusion molding (the tubing method).

The surface of the elastic layer 14 with the coating thereon, that is, the surface of the coating, is coated with fine particles of a fluorine resin or a dispersion of fine particles of a fluorine resin in a medium. Then the fine particles or dispersion is dried, fused, and fired (the coating method).

The tubing method may include subjecting the inner surface of the fluorine resin tube, or the surface that comes into contact with the adhesive layer 15, to a surface treatment such as excimer laser, sodium, or ammonia treatment. Such a surface treatment produces many OH groups on the inner surface of the fluorine resin tube, and these OH groups should form strong connections with the adhesive layer 15. The excimer laser treatment can be performed by irradiating the inner surface of the tube with a laser. The sodium treatment can be performed by applying a dispersion of an alkali metal, such as metallic sodium, to the inner surface of the tube.

In the coating method, although the reason has yet to be fully understood, it appears that connections between the OH groups the fine particles of a fluorine resin, which may be in the form of dispersion, have their surface and the vinyl groups in the adhesive layer firmly join the elastic layer 14 and the surface layer 16 together.

The obtained multilayer body is heated to cure the polyimide silicone and bond the elastic layer 14 and the surface layer 16 together. When the tubing method is used, the heating temperature can be 150° C. or more and 400° C. or less, in particular, 200° C. or more and 250° C. or less. The heating time can be 10 minutes or more and 1 hour or less, in particular, 20 minutes or more and 1 hour or less. Heating the multilayer body for a period in these ranges will produce a strong bond with limited thermal deterioration of the cured silicone rubber elastic layer. When the coating method is used, the heating temperature can be 300° C. or more and 400° C. or less, in particular, 330° C. or more and 390° C. or less. The heating time can be 1 minute or more and 30 minutes or less, in particular, 2 minutes or more and 15 minutes or less. Heating the multilayer body for a period in these ranges and at a temperature in the above ranges will bring the fluorine resin into complete fusion and allow it to form a coating and will, furthermore, produce a strong bond with limited thermal deterioration of the cured silicone rubber elastic layer.

(7) Peel Test

Regarding the member for electrophotography according to an aspect of the disclosure, the elastic layer 14 undergoes a cohesive failure when a peel test of the surface layer 16 from the elastic layer 14 is conducted after the member is left in the environment of 260° C. for 10 hours.

The term "peel test" as mentioned herein refers to the 90° peel test according to Japanese Industrial Standards (JIS) K6854-1: 1999 for the determination of the peel strength of bonded assemblies (hereinafter also simply referred to as "a peel test").

By leaving the member of electrophotography under high-temperature conditions at 260° C., a temperature higher than those for use with an ordinary fixing device, e.g., 100° C. to 190° C., it is possible to evaluate the high-temperature bond durability of the member for electrophotography quicker than normal. If the elastic layer 14 undergoes a cohesive failure in a peel test after going through this study of heat resistance, it means that the elastic layer 14 and the surface layer 16 are firmly bonded together.

Figure 2:
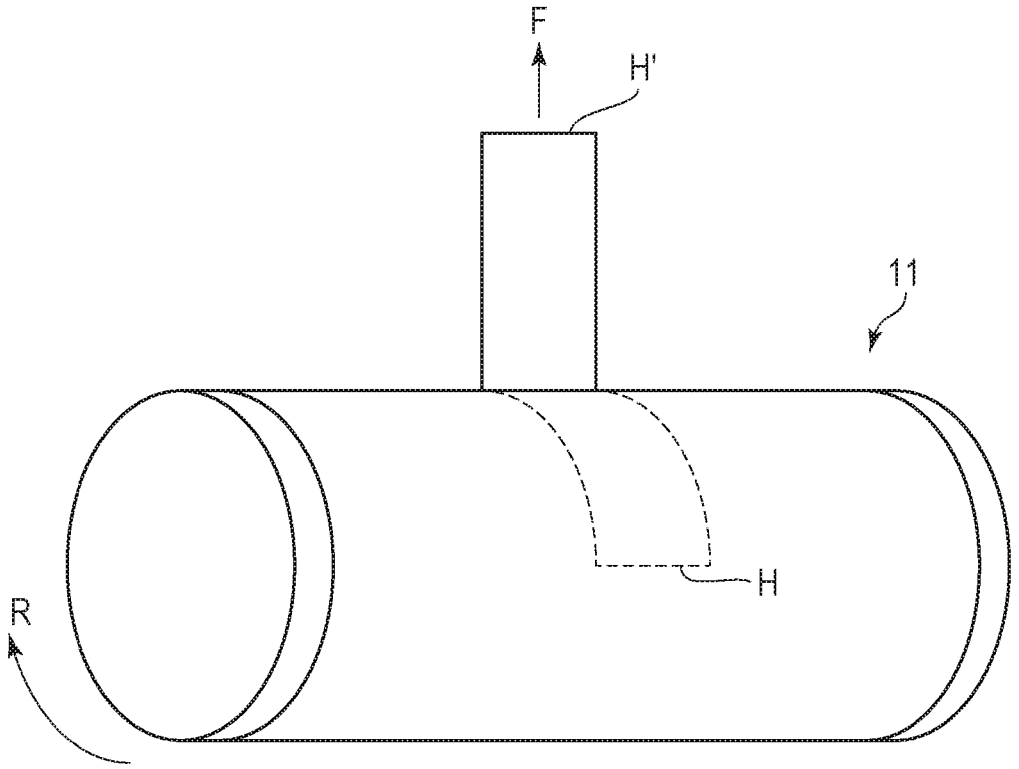
FIG. 2 is an illustrative representation of the peel test.

The method of the peel test is described with reference to FIG. 2. A core (not illustrated) put through the fixing belt 11 is held by sandwiching both ends of the core from outside with bearings (not illustrated) configured to rotate in direction R in the drawing. Then 10-mm wide slits are created using a razor blade from the surface of the surface layer to the surface of the elastic layer 14. The depth of the slits is approximately 40 to 200 μm (any depth where the slits reach the inside of the elastic layer 14). Then one longitudinal cut is made in the slit portion of the member for electrophotography, and this line is defined as the peel head H. Then the surface portion of the fixing belt is lifted as illustrated in FIG. 2, starting at the peel head H to approximately 5 to 20 mm.

The peel head H' is then pulled in the vertical direction F from right above the axis of rotation of the core at a rate of 50 mm/min, peeling back the surface portion to a circumferential length of 70 mm. The direction of peeling F remains at 90° to the tangent to the main body of the fixing belt 11 at the bottom of the peel head H' until the length of the lifted portion reaches at least 70 mm. A specific example of a method to maintain an angle of 90° is as follows: hold the peel head H with the force gauge (not illustrated) of the peel tester, with the lifted surface portion at an angle of 90°; then pull the lifted portion at a constant rate (50 mm/min) in the vertical direction F from right above the axis of rotation of the core while rotating the core in direction R in the drawing to make the rate of the tangential movement of the core match that of the peel head H in the vertical direction F. To be more specific, when the outer diameter of the fixing belt 11 is 30 mm, rotating the core at a speed of 0.53 rpm will keep the direction of peeling F at 90° to the tangent to the main body of the fixing belt 11 at the bottom of the peel head H.

The mode of delamination of the elastic layer 14 is determined from the condition of the fracture surface formed in the peel test in accordance with Japanese Industrial Standards (JIS) K6866: 1999, "Adhesives—Designation of main failure patterns."

Adhesive failure: Rupture of an adhesive bond in which the separation appears visually to be at the adhesive/adherend interface Cohesive failure: Rupture of a bonded assembly in which the separation appears visually to be in the adhesive or the adherend A cohesive failure of the elastic layer 14 therefore refers to a rupture in which the separation in the fracture surface appears visually to be in the elastic layer 14.

(8) Fixing Device

A fixing device is a device configured to heat-press a recording medium carrying an image. An example of a fixing device is one configured to permanently or temporarily fix a toner image on a recording medium through heat pressing. Other examples include a gloss-enhancing device, which is a device configured to improve the gloss of an image fixed on a recording medium by heat-pressing the image, and a device configured to dry a recording medium having an inkjet-formed image thereon by heat-pressing the recording medium.

Figure 4A:
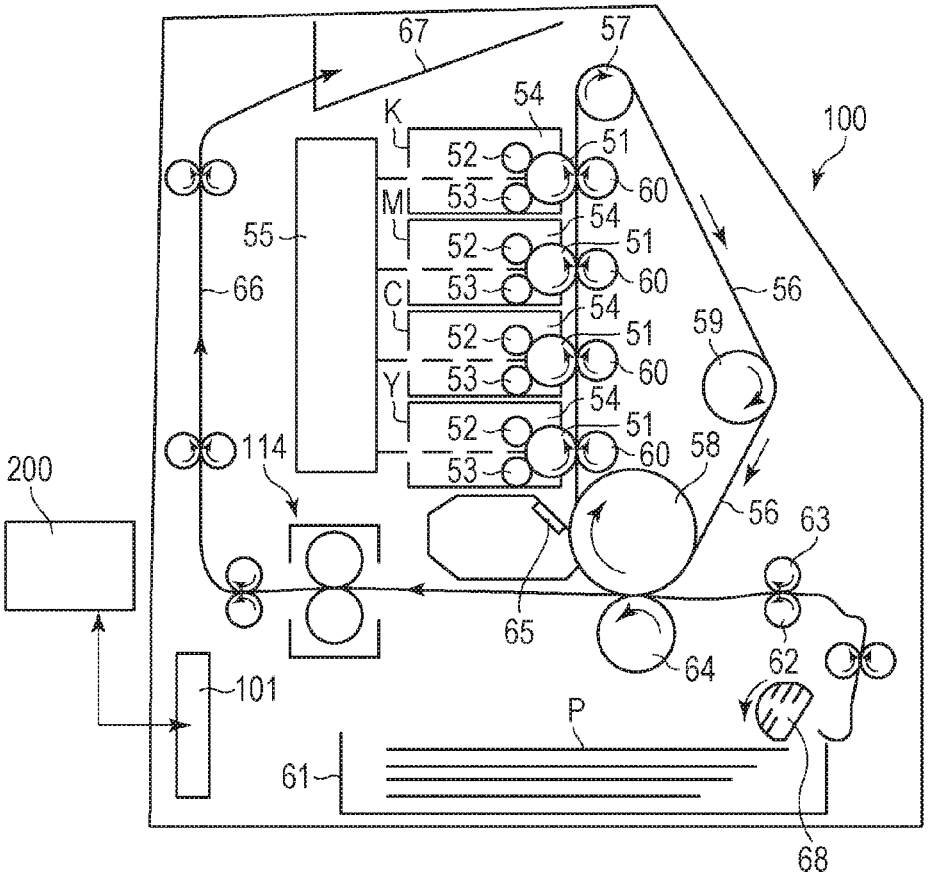
FIGS. 4A and 4B are schematic cross-sectional views of an example of an image-forming apparatus and an example of a fixing device, respectively, according to an aspect of the disclosure.
Figure 4B:
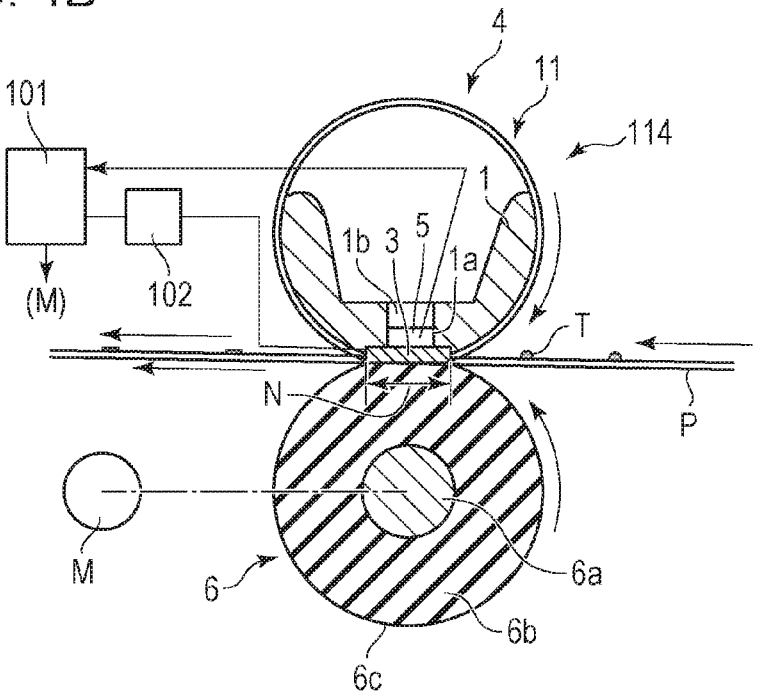

FIG. 4B is a schematic cross-sectional view of some essential components of a fixing device 114 which includes a fixing belt 11. In the following description, the longitudinal and lateral directions as mentioned in relation to this fixing device and the structural members of the fixing device refer to the directions on the surface of the recording medium perpendicular and parallel, respectively, to the direction in which the recording medium is fed. A width and a length refer to dimensions measured in the lateral and longitudinal directions, respectively.

The fixing device 114 according to this embodiment is basically a tensionless film-heating fixing device which is a known technology. The film-heating fixing device includes a flexible, heat-resistant, endless-belt-shaped or cylindrical fixing belt 11. At least part of the periphery of this fixing belt 11 is always tension-free (i.e., under no tension), and the fixing belt 11 is driven to rotate by the rotational driving force transmitted from a pressure roller (a rotating body for pressing) 6.

In FIG. 4B, a stay 1, which supports a heating element and guides the film, is a rigid member made of a heat-resistant resin in the shape of a trough elongated in the longitudinal direction and having a substantially semicircular cross-section. In this embodiment, the stay 1 is made of a liquid crystal polymer, which is a highly heat-resistant material. The stay 1 has an opening 1*b* near its middle in the longitudinal direction in communication with a groove 1*a*, and the opening 1*b* contains a thermistor (temperature detection element) 5 provided in contact with a heater 3 as the heating unit. The heater 3 in this embodiment, what is called a ceramic heater, is held in the groove 1*a*. The groove 1*a* is located in the middle of the bottom surface of the stay 1 in the lateral direction and extends along the longitudinal direction of the stay 1.

The fixing belt 11 as a member for electrophotography is a flexible, highly heat-resistant cylindrical belt fit loosely, or with a surplus of circumferential length, around the outer periphery of the stay 1 holding the heater 3. The inner periphery (inner surface) of the fixing belt 11 has been greased for smoother slides on the heater 3. The stay 1, the heater 3, and the fixing belt 11 constitute a heating assembly 4.

The pressure roller (rotating body for pressing) 6 as a back-up member faces the heater 3 held by the stay 1, with the fixing belt 11 therebetween. The pressure roller 6 in this embodiment is composed of a metal round shaft 6*a* made of iron, stainless steel, aluminum, or similar, a heat-resistant elastic layer 6*b* made of silicone foam covering the shaft, and a release layer 6*c* which is a fluorine resin tube covering the elastic layer. The stay 1 and the pressure roller 6 are pressed against each other at a predetermined pressure by a pressure mechanism (not illustrated). This pressure makes the elastic layer 6*b* of the pressure roller 6 elastically deform conforming to the heater 3 with the fixing belt 11 therebetween. This provides a nip (fixing nip) N having a predetermined width required to heat and fix the toner image T on the recording medium P between the pressure roller 6 and the fixing belt 11.

The pressure roller 6 is driven by a motor (drive unit) M under the control of a control circuit 101 to rotate counterclockwise, or in the direction of the arrow, at a predetermined velocity at least during the formation of an image. The rotation of the pressure roller 6 generates frictional force between the pressure roller 6 and the fixing belt 11 at the nip N. This makes the fixing belt 11 rotate clockwise, or in the direction of the arrow, around the stay 1 at a circumferential velocity substantially equal to the circumferential velocity of the rotating pressure roller 6 with its inner surface sliding on the bottom surface of the heater 3. In other words, the fixing belt 11 is rotated at a circumference velocity substantially equal to the velocity at which the recording medium P carrying the toner image T is fed from the image-forming section side.

The heater 3 warms up using electricity it receives from a power supply 102. The temperature of the heater 3 is detected by the thermistor 5, the detected temperature information is fed back to the control circuit 101. The control circuit 101 controls the supply of electricity from the power supply 102 to the heater 3 to maintain the detected temperature communicated from the thermistor 5 at a predetermined target (fixing temperature).

While the heater 3 is kept at the predetermined fixing temperature and the pressure roller 6 is driven to rotate, the recording medium P carrying the toner image T is introduced to the nip N with its image-carrying surface on the fixing belt 11 side. At the nip N, the recording medium P is attached firmly to the outer surface of the fixing belt 11 and conveyed together with the fixing belt 11. This transmits the heat of the heater 3 and pressure to the recording medium P via the fixing belt 11 and the pressure roller 6, respectively, fixing the toner image T on the surface of the recording medium P. After passing through the nip N, the recording medium P leaves the outer periphery of the fixing belt 11 and is ejected from the fixing device.

(9) Image-Forming Apparatus

FIG. 4A is a schematic view of an example of an image-forming apparatus 100 which includes a fixing device configured to fix a toner image on a recording medium through heat pressing, and this fixing device is the fixing device 114 which includes the fixing belt 11. This image-forming apparatus 100 is an electrophotographic color printer.

The image-forming apparatus 100 receives an electric image signal from an external host device 200, such as a personal computer or an image reader, at its control circuit (control unit) 101 and transforms this signal into a color image on a sheet-shaped recording medium P. The control circuit 101, which includes a CPU (a processor) and a ROM (a memory), communicates a variety of electrical information to and from the host device 200 and the controls (not illustrated) for the image-forming apparatus 100. The control circuit 101 centrally controls the production of images by the image-forming apparatus 100 in accordance with predetermined control programs and reference tables.

There are four image-forming sections Y, C, M, and K configured to produce toner images in yellow, cyan, magenta, and black, respectively. In the image-forming apparatus, they are arranged in the order of Y, C, M, and K, from lower to higher positions. Each of the image-forming sections Y, C, M, and K has an electrophotographic photosensitive drum 51 as an image carrier, and also has a charging device 52, a developing device 53, and a cleaning device 54 as process components configured to act on this drum 51. The developing devices 53 in the yellow, cyan, magenta, and black image-forming sections Y, C, M, and K contain yellow, cyan, magenta, and black toners, respectively, as developers. There is an optical system 55 for these four-color image-forming sections Y, C, M, and K, configured to form electrostatic latent images by exposing the drums 51 to light. The optical system is a laser-scanning exposure optical system.

In each of the image-forming sections Y, C, M, and K, the drum 51 uniformly charged by the charging device 52 is scanned with light emitted from the optical system 55, the pattern of light being based on the image data. This produces an electrostatic latent image on the surface of the drum. The resulting electrostatic latent images are developed into toner images by the developing devices 53. For example, in the yellow image-forming section Y, a yellow toner image corresponding to the yellow component of a full-color image is produced on the drum 51.

The toner images produced on the drums 51 in the image-forming sections Y, C, M, and K are then subjected to primary transfer. That is, the toner images are superimposed in a predetermined state of alignment on an intermediate transfer unit 56 which rotates at a substantially constant velocity in synchronization with the rotation of the drums 51. This synthesizes a full-color toner image on the intermediate transfer unit 56. In this embodiment, the intermediate transfer unit 56 is an endless intermediate transfer belt. The belt 56 is stretched around three rollers, which are a drive roller 57, a secondary transfer roller-facing roller 58 (a roller facing a secondary transfer roller), and a tension roller 59, and is driven by the drive roller 57.

The primary transfer, i.e., the transfer of a toner image from the drum 51 in one of the image-forming sections Y, C, M, and K to the belt 56, is performed using a primary transfer roller 60. To the roller 60, a primary transfer bias having the reverse polarity with respect to the toner is applied using a bias power supply (not illustrated). This transfers the toner image from the drum 51 in the image-forming section Y, C, M, or K to the belt 56, completing the primary transfer.

After the primary transfer, or the transfer of a toner image from the drum 51 in the image-forming section Y, C, M, or K to the belt 56, any toner remaining on the drum 51 is removed by the cleaning device 54.

This process is performed for each of the yellow, cyan, magenta, and black colors in synchronization with the rotation of the belt 56 to sequentially produce toner images in these colors and superimpose them on the belt 56. When a single-color image is formed (in the single-color mode), this process is performed for the intended color only.

Separately, a sheet of the recording medium P in a recording medium cassette 61 is taken up and fed by a feeding roller 68 with predetermined timing. This sheet of recording medium P is conveyed by registration rollers 62 and 63 to a transfer nip, the point where the intermediate transfer belt turned around the secondary transfer roller-facing roller 58 and a secondary transfer roller 64 are pressed against each other, with predetermined timing. When a bias having the reverse polarity with respect to the toners is applied to the secondary transfer roller 64 using a bias power supply (not illustrated), the toner images on the belt 56 are transferred all together to the sheet of recording medium P (secondary transfer).

Any toner remaining on the belt 56 after the secondary transfer is removed by an intermediate transfer belt cleaning device 65 (a cleaning device for the intermediate transfer belt). The toner image transferred to the sheet of recording medium P, or the image after the secondary transfer, is fused for color mixing and fixed by the fixing device 114, and the resulting full-color printout is ejected through an output path 66 to an output tray 67.

EXAMPLES

The following describes certain aspects of the disclosure in further detail using examples. Although these examples are possible embodiments of certain aspects of the disclosure, no aspect of the disclosure is limited to these examples while within the scope of the disclosure, and various modifications are possible within the spirit of those aspects of the disclosure.

Example 1

As a substrate of a fixing belt, a stainless-steel film having an outer diameter of 30 mm, a thickness of 40 μm, and a longitudinal length of 400 mm was prepared.

To this stainless-steel film, an addition-curing silicone rubber composition (trade name, XE15-B9236; Momentive Performance Materials Japan) was applied using a ring-shaped coating head to form a coating. The thickness of the coating was 300 μm. The H/Vi of the addition-curing silicone rubber was 1.1.

Through the heating of this coating to 200° C., the addition-curing silicone rubber in the coating was allowed to react. In this way, an elastic layer containing silicone rubber was formed.

The surface of the elastic layer was irradiated in an air atmosphere at room temperature for 90 seconds using an excimer lamp (trade name, MEBF-460BQ; M.D. Excimer Inc.) placed 2 mm from the surface while the film was rotated at a circumferential velocity of 70 mm/sec.

A solution of uncured polyimide silicone in an organic solvent (trade name, SMP-5005-PGMEA; Shin-Etsu Chemical) was applied to the elastic layer by spray coating to form a coating that would be 3 to 4 μm in thickness after being dried. The coating was dried by heating at 100° C. for 1 hour. In this way, a layer of adhesive was formed.

An aqueous dispersion of PFA particles (trade name, AW-5000L; Daikin Industries) was applied to the layer of adhesive using spray coating to form a PFA-dispersed coating that would provide a 25-μm thick surface layer by being fired. The coating was heated to 350° C. and maintained at this temperature for 15 minutes so that the PFA particles in the coating would fuse and that bonds would be formed between the elastic and adhesive layers and the adhesive and surface layers through addition reaction. In this way, a fixing belt was produced.

Evaluation of the Mode of Delamination

The produced fixing belt was subjected to the aforementioned peel test immediately after production (baseline) and after 10 hours of heating in an oven at 260° C. The results of the evaluation of the mode of delamination are summarized in Table.

The fixing belt according to Example 1 was broken with a cohesive failure of its elastic layer even after being left at a high temperature, demonstrating that bonding strength was maintained even under high-temperature conditions.

Example 2

A silicone-rubber-containing elastic layer was formed on a stainless-steel film in the same way as in Example 1.

The surface of the elastic layer was treated using an excimer lamp in the same way as in Example 1. A solution of uncured polyimide silicone in an organic solvent (trade name, SMP-5005-PGMEA; Shin-Etsu Chemical) was applied to the elastic layer by spray coating to form a coating that would be 3 to 4 μm in thickness after being dried. The coating was dried by heating at 100° C. for 1 hour. In this way, a layer of adhesive was formed.

A fluorine resin tube having a length of 400 mm, an inner diameter of 29 mm, and a thickness of 20 μm and having its inner surface treated using an excimer laser (trade name, KURANFLON-LT; Kurabo Industries) was put on the layer of adhesive. The fluorine resin tube on the surface of the belt was uniformly rubbed for firm attachment to the adhesive layer. This tube-covered belt was heated to 200° C. and maintained at this temperature for 20 minutes so that bonds would be formed between the elastic and adhesive layers and the adhesive and surface layers through addition reaction. In this way, a fixing belt was produced.

The produced fixing belt was subjected to a peel test in the same way as in Example 1. The results of the evaluation of the mode of delamination are summarized in Table.

Example 3

As a substrate of a fixing belt, a stainless-steel film having an outer diameter of 30 mm, a thickness of 40 μm, and a longitudinal length of 400 mm was prepared.

Then 100 parts by mass of an addition-curing silicone rubber (trade name, XE15-B9236; Momentive Performance Materials Japan) was mixed with 3.0 parts by mass of anatase A (trade name, Titanium Oxide (IV), Anatase Form 208-18231; Wako Pure Chemical Industries; a volume-average particle diameter of 30 nm), and the resulting mixture was thoroughly kneaded. The obtained silicone rubber composition was applied to the stainless-steel film using a ring-shaped coating head to form a coating. The thickness of the coating was 300 μm.

Through the heating of this coating to 200° C., the addition-curing silicone rubber in the coating was allowed to react. In this way, an elastic layer containing silicone rubber was formed.

Subsequently, the same procedure as in Example 2 was performed to complete a fixing belt.

The produced fixing belt was subjected to a peel test in the same way as in Example 1. The results of the evaluation of the mode of delamination are summarized in Table.

Example 4

As a substrate of a fixing belt, a stainless-steel film having an outer diameter of 30 mm, a thickness of 40 μm, and a longitudinal length of 400 mm was prepared.

Agents A and B for an addition-curing silicone rubber (trade name, XE15-B9236; Momentive Performance Materials Japan) were mixed in a 2.2:1 ratio. The H/Vi of the resulting addition-curing silicone rubber was 0.7. Then 100 parts by mass of this addition-curing silicone rubber was mixed with 3.0 parts by mass of anatase A (trade name, Titanium Oxide (IV), Anatase Form 208-18231; Wako Pure Chemical Industries; a volume-average particle diameter of 30 nm), and the resulting mixture was thoroughly kneaded. The obtained silicone rubber composition was applied to the stainless-steel film using a ring-shaped coating head to form a coating. The thickness of the coating was 300 μm.

Through the heating of this coating to 200° C., the addition-curing silicone rubber in the coating was allowed to react. In this way, an elastic layer containing silicone rubber was formed.

The surface of the elastic layer was treated using an excimer lamp in the same way as in Example 1.

A solution of uncured polyimide silicone in an organic solvent (trade name, SMP-5005-PGMEA; Shin-Etsu Chemical) was applied to the elastic layer by spray coating to form a coating that would be 3 to 4 μm in thickness after being dried. The coating was dried by heating at 100° C. for 1 hour. In this way, a layer of adhesive was formed.

Subsequently, the same procedure as in Example 2 was performed to complete a fixing belt.

The produced fixing belt was subjected to a peel test in the same way as in Example 1. The results of the evaluation of the mode of delamination are summarized in Table.

Comparative Example 1

A silicone-rubber-containing elastic layer was formed on a stainless-steel film in the same way as in Example 1, and the surface of the elastic layer was treated using an excimer lamp in the same way as in Example 1.

An aqueous fluorine resin primer containing phosphoric groups was applied by spray coating to form an adhesive layer that would be 2 to 3 μm in thickness after being dried. An aqueous dispersion of PFA particles (trade name, AW-5000L; Daikin Industries) was applied by spray coating to form a PFA-dispersed coating that would be 25 μm thick after being fired. This coating was heated to 350° C., completing a fixing belt.

The produced fixing belt was subjected to a peel test in the same way as in Example 1. The results of the evaluation of the mode of delamination are summarized in Table.

Comparative Example 2

A fixing belt was produced in the same way as in Example 1, except that a solution of a different uncured polyimide silicone in an organic solvent (trade name, SMP-4001; Shin-Etsu Chemical) was used to form the adhesive layer. The molecule of the polyimide silicone in this coating solution contains no vinyl groups.

The produced fixing belt was subjected to a peel test in the same way as in Example 1. The results of the evaluation of the mode of delamination are summarized in Table.

Comparative Example 3

A fixing belt was produced in the same way as in Example 2, except that a solution of a different uncured polyimide silicone in an organic solvent (trade name, SMP-4001; Shin-Etsu Chemical) was used to form the adhesive layer. The molecule of the polyimide silicone in this coating solution contains no vinyl groups.

The produced fixing belt was subjected to a peel test in the same way as in Example 1. The results of the evaluation of the mode of delamination are summarized in Table.

TABLE

| | H/Vi | Titanium oxide (anatase form) | Baseline mode of delamination | Mode of delamination after heat-resistance test |
|---|---|---|---|---|
| Example 1 | 1.1 | Not used | Cohesive failure of elastic layer | Cohesive failure of elastic layer |
| Example 2 | 1.1 | Not used | Cohesive failure of elastic layer | Cohesive failure of elastic layer |
| Example 3 | 1.1 | Used | Cohesive failure of elastic layer | Cohesive failure of elastic layer |
| Example 4 | 0.7 | Used | Cohesive failure of elastic layer | Cohesive failure of elastic layer |
| Comparative Example 1 | 1.1 | Not used | Cohesive failure of elastic layer | Adhesive failure of surface-adhesive bond |
| Comparative Example 2 | 1.1 | Not used | Adhesive failure of surface-adhesive bond | Adhesive failure of surface-adhesive bond |
| Comparative Example 3 | 1.1 | Not used | Adhesive failure of surface-adhesive bond | Adhesive failure of surface-adhesive bond |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-037024 filed Feb. 26, 2015, which is hereby incorporated by reference herein in its entirety.

What is claimed is:

1. A member for electrophotography, comprising
a substrate,
an elastic layer comprising a silicone rubber,
a surface layer comprising a fluorine resin, and
an adhesive layer between the elastic layer and the surface layer,
wherein the adhesive layer contains a polyimide silicone, and
wherein when a peel test of the surface layer from the elastic layer is conducted after the member is left in the environment of 260° C. for 10 hours, the elastic layer undergoes a cohesive failure.

2. The member according to claim 1, wherein the elastic layer has a tensile strength of 0.4 MPa or more and 3.0 MPa or less.

3. The member according to claim 1, wherein the elastic layer is a cured layer of an addition-curing silicone rubber composition.

4. The member according to claim 1, wherein the elastic layer contains an unsaturated aliphatic group.

5. The member according to claim 1, wherein the member is in the shape of a belt, and wherein the elastic layer has a thickness of 100 μm or more and 500 μm or less.

6. The member according to claim 1, wherein the member is in the shape of a roller, and wherein the elastic layer has a thickness of 300 μm or more and 10 mm or less.

7. A method for producing a member for electrophotography having a substrate, an elastic layer containing a silicone rubber, and a surface layer containing a fluorine resin, the method comprising a step of:
bonding the elastic layer and the surface layer by forming, on a surface of the elastic layer, a coating of a polyimide silicone having a vinyl group in a molecule thereof, and curing the coating.

8. The method according to claim 7, further comprising; forming the elastic layer by curing an addition-curing silicone rubber composition containing an addition-curing silicone rubber solution and titanium oxide in an anatase form.

9. The method according to claim 8, wherein the addition-curing silicone rubber solution contains unsaturated aliphatic groups and active hydrogen groups in a ratio by number of 0.3 or more and 1.5 or less.

10. An image-forming apparatus comprising a fixing device including a fixing member and a heating unit,
the fixing member comprising a substrate,
an elastic layer comprising a silicone rubber,
a surface layer comprising a fluorine resin, and
an adhesive layer between the elastic layer and the surface layer,
wherein the adhesive layer contains a polyimide silicone, and
wherein when a peel test of the surface layer from the elastic layer is conducted after the member is left in the environment of 260° C. for 10 hours, the elastic layer undergoes a cohesive failure.

11. A member for electrophotography, comprising
a substrate,
an elastic layer comprising a silicone rubber,
a surface layer comprising a fluorine resin, and
an adhesive layer between the elastic layer and the surface layer,
wherein the adhesive layer contains a polyimide silicone,
wherein when a peel test of the surface layer from the elastic layer is conducted after the member is left in the environment of 260° C. for 10 hours, the elastic layer undergoes a cohesive failure, and
wherein the elastic layer contains titanium oxide in an anatase form.

12. A member for electrophotography, comprising
a substrate,
an elastic layer comprising a silicone rubber,
a surface layer comprising a fluorine resin, and
an adhesive layer between the elastic layer and the surface layer,
wherein the adhesive layer contains a polyimide silicone,
wherein when a peel test of the surface layer from the elastic layer is conducted after the member is left in the environment of 260° C. for 10 hours, the elastic layer undergoes a cohesive failure and
wherein the adhesive layer is a cured layer of a polyimide silicone having a vinyl group in a molecule thereof.

* * * * *